US006170631B1

(12) United States Patent
Miyazaki

(10) Patent No.: US 6,170,631 B1
(45) Date of Patent: Jan. 9, 2001

(54) PAPER-LEAVES DISCRIMINATING APPARATUS AND SENSOR MOUNTING CONSTRUCTION OF SAME APPARATUS

(75) Inventor: Toshimasa Miyazaki, Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 09/275,035

(22) Filed: Mar. 24, 1999

(30) Foreign Application Priority Data

Jul. 28, 1998 (JP) ..... 10-212182

(51) Int. Cl.[7] ..... G07D 7/00
(52) U.S. Cl. ..... 194/200; 194/206
(58) Field of Search ..... 194/200, 206, 194/207; 209/534; 382/135; 356/71; 250/556

(56) References Cited

U.S. PATENT DOCUMENTS 3,480,785 * 11/1969 Aufderheide ..... 194/207 X
5,420,406 5/1995 Izawa et al. .

FOREIGN PATENT DOCUMENTS 0762 344 A1 3/1997 (EP) .
58-056088 4/1983 (JP) .
63-300375 12/1988 (JP) .
2-167490A 6/1990 (JP) .
4-291485A 10/1992 (JP) .
6-301839A 10/1994 (JP) .
WO92/18953 * 10/1992 (WO) ..... 194/206
WO 96/10800 4/1996 (WO) .

* cited by examiner

*Primary Examiner*—F. J. Bartuska

(57) ABSTRACT

The present invention relates to a paper-leaves discriminating apparatus (sensor mounting construction) which is capable of detecting a characteristic quantity at a point conforming to a discriminating way while easily coping with a change of the way. Thus, in the paper-leaves discriminating apparatus according to this invention, a sensor is made up of a plurality of characteristic quantity detecting heads, and a plurality of head mounting holes are made in a frame installed along a conveyance plane of paper leaves for mounting the plurality of characteristic quantity detecting heads on the frame so that the plurality of characteristic quantity detecting heads face the conveyance plane, and further, each of the characteristic quantity detecting heads is detachably fitted in the head mounting hole, of the plurality of head mounting holes, corresponding to a position at which the characteristic quantity remarkably develops. Further, this invention is applied in discriminating between the truth and falsehood or sorts of paper leaves (for example, paper money, securities) in automatic teller machines (ATM), vending machines or the like.

12 Claims, 10 Drawing Sheets

PAPER-LEAVES DISCRIMINATING APPARATUS AND SENSOR MOUNTING CONSTRUCTION OF SAME APPARATUS

BACKGROUND OF THE INVENTION

1) Field of the Invention

The present invention relates to a paper-leaves discriminating apparatus for use in automatic teller machines (ATM), vending machines or the like for the purpose of discriminating between the truth and falsehood or sorts of paper leaves (for example, paper money, securities), and more particularly to a mounting construction for a sensor made to take out characteristic quantity information (magnetic information, printed image information, optical information, and others) needed for the discrimination from paper leaves.

2) Description of the Related Art

In general, in an automatic teller machine, a vending machine or the like, a paper-leaves discriminating apparatus is installed in order to discriminate between the truth and falsehood or sorts of paper money (paper leaves) inserted thereinto. A description will be made hereinbelow as the paper-leaves discriminating apparatus is an apparatus for discriminating between the truth and falsehood of paper money, that is, serves as a paper money discriminating machine.

FIG. 10 is a block diagram showing a construction of a common paper money discriminating machine. As shown in FIG. 10, the common paper money discriminating machine is made up of an image sensor 101, a magnetic line sensor 102, an image sensor database 103, a magnetic line sensor database 104, a discriminating circuit 105 and a truth-falsehood deciding circuit 106.

The image sensor 101 and the magnetic line sensor 102 are fitted to a frame of the paper money discriminating machine 100, and are disposed along a conveyance passage of paper money (paper leaves) 110 inserted from the outside.

The image sensor 101 is for reading out a printed image on the paper money 110, while the magnetic line sensor 102 is for detecting a quantity of magnetism contained in ink forming the printed image on the paper money 110. This magnetic line sensor 102 is constructed by integrally forming, for example, 32 (or 64) magnetic detecting elements, and is disposed along the longitudinal direction of the paper money (a direction perpendicular to the conveying direction of the paper money 110) to detect magnetic quantities at 32 (or 64) points existing within a range of the entire width of the paper money 110 in its longitudinal direction.

Furthermore, the image sensor database 103 is made to store information about a printed image on normal paper money beforehand, while the magnetic line sensor database 104 is made to store magnetic quantities at the aforesaid 32 (or 64) points existing over the entire width of normal paper money in its longitudinal direction in advance.

Still further, the discriminating circuit 105 checks the printed image on the paper money 110 read through the image sensor 101 with the printed image information on the normal paper money stored in the image sensor database 103, and further, checks the magnetic intensity at each of the points detected through the magnetic line sensor 102 with the magnetic intensity at each of the points of the normal paper money, stored in the magnetic line sensor database 104, thereby accomplishing the discrimination of the paper money 110.

The truth-falsehood deciding circuit 106 makes a decision on whether the paper money 110 is true or false, on the basis of the discrimination result (information about the check result) by the discriminating circuit 105.

In the paper money discriminating machine thus constructed, the paper money 110 inserted from the outside is conveyed along the conveyance passage while the printed image on the paper money 110 is read through the image sensor 101, and the magnetic quantities at the aforesaid 32 (or 64) points existing over the entire width of the paper money 110 in its longitudinal direction are detected through the magnetic line sensor 102.

The information obtained by these sensors 101 and 102 are inputted to the discriminating circuit 105 where the printed image on the paper money 110 from the image sensor 101 is checked with the printed image information about the normal paper money in the image sensor database 103, and the magnetic intensity obtained from the magnetic line sensor 102 is checked with the magnetic intensity of the normal paper money in the magnetic line sensor database 104, thereby making the discrimination of the paper money 110. Further, the truth-falsehood deciding circuit 106 finally makes a decision, on the basis of the discrimination result (information about the check result) by the discriminating circuit 105, on whether the paper money 110 is true or false.

In the above-described paper money discriminating machine, the magnetic line sensor 102 detects the magnetic information on the paper money 110, being discriminated, at many points existing over its entire width to extract a characteristic (magnetic distribution) such as the configuration of points having a high magnetic intensity and points having a low magnetic intensity so that a decision between the truth and the falsehood of the paper money 110 is made in a manner that the extracted characteristic is checked with the magnetic intensity information (magnetic distribution) on the normal paper money in the magnetic line sensor database 104.

Thus, the following problems come about. That is, the magnetic line sensor 102 involves a special order conforming to the sizes of paper money to be discriminated, which extremely raises its cost. In addition, since the magnetic line sensor database 104 is required to store a bulky volume of magnetic intensity information, the circuit for this magnetic line sensor database 104 or the check processing circuit becomes complicated and costly. Besides, the discriminating processing takes a long period of time.

Incidentally, the employment of the above-mentioned magnetic line sensor 102 permits a change or addition of the checking magnetic intensity information to be stored in the magnetic line sensor database 104 to easily deal with the case of a change of the discriminating way (for example, the replacement of the issuing nation or sort of the paper money to be discriminated or the addition of new paper money to be discriminated).

Meanwhile, in the case that the check of paper money relies upon the magnetic quantities, in fact, there is no need to use the magnetic distribution over the entire width of the paper money, and since the magnetic characteristic of the paper money appears or develops at several places in the width direction (direction perpendicular to the conveyance direction) of the paper money, the detection of the magnetic quantities at the several places allows the check of the paper money depending upon the magnetic quantities.

For this reason, consideration may be given to fixedly attaching a plurality of magnetic heads to a frame in order to detect the magnetic quantities at several places. However, the employment of such a structure makes it difficult to easily cope with the change of paper money to be discriminated. That is, the replacement of the paper money signifies the variation of the position at which the magnetic characteristic appears, and therefore, involves the change of the locations of the plurality of magnetic head, which requires the replacement of the frame itself.

SUMMARY OF THE INVENTION

Accordingly, the present invention has been developed with a view to eliminating this problem, and it is therefore an object of this invention to provide a paper-leaves discriminating apparatus and a sensor mounting construction for the same apparatus which are capable of detecting a characteristic quantity at a point conforming to a way, while easily dealing with the change of the way, to thereby simplify the check database and the check processing circuit, and thus accomplishing the reduction of cost and decision processing time.

For this purpose, according to this invention, a paper-leaves discriminating apparatus comprises a sensor for detecting characteristic quantity information in paper leaves needed for discrimination between the truth and falsehood or among the sorts of paper leaves, a check data base for storing characteristic quantity information on normal paper leaves and a discriminating circuit for making a discrimination by checking the characteristic quantity information in the paper leaves detected by the sensor with the characteristic quantity information in the check database, wherein the sensor is composed of a plurality of characteristic quantity detecting heads each for detecting the characteristic quantity information, and a frame on which the characteristic quantity detecting heads are mounted is provided along a conveyance plane of the paper leaves, and has a plurality of head mounting holes for mounting the plurality of characteristic quantity detecting heads on the frame in a state where the characteristic quantity detecting heads face the conveyance plane, and each of the characteristic quantity detecting heads is detachably fitted in only the head mounting hole, of the plurality of head mounting holes, corresponding to a position at which a characteristic quantity remarkably develops.

At this time, it is also possible that a dummy head is detachably fitted in the head mounting hole, of the plurality of head mounting holes, in which the characteristic quantity detecting head is not fitted, to close the head mounting hole in a state of facing the paper leaves conveyance plane.

Furthermore, it is also appropriate that a back-up characteristic quantity detecting head to be used at the time of the occurrence of a trouble of the characteristic quantity detecting head is detachably fitted in some of the plurality of head mounting holes, and a switching circuit is provided which, when the characteristic quantity detecting head gets into trouble, automatically conducts a switching operation so that the back-up characteristic quantity detecting head detects the characteristic quantity information, and further, characteristic quantity information on the normal paper leaves at the fitted position of the back-up characteristic quantity detecting head is previously stored as back-up characteristic quantity information in the check database so that the discriminating circuit makes a discrimination by checking the characteristic quantity information detected by the back-up characteristic quantity detecting head with the back-up characteristic quantity information in the check database at the trouble of the characteristic quantity detecting head.

Still further, it is also acceptable that each of the characteristic quantity detecting heads is a magnetic head made to detect, as the characteristic quantity information, a quantity of the magnetism contained in a printed image on the paper leaves.

Meanwhile, in accordance with this invention, there is provided a sensor mounting construction in a paper-leaves discriminating apparatus which makes a discrimination between the truth and the falsehood or among sorts of paper leaves, the sensor mounting construction being for mounting a sensor for detecting characteristic quantity information in the paper leaves needed for the discrimination, wherein the sensor is composed of a plurality of characteristic quantity detecting heads each for detecting the characteristic quantity information therein, and a plurality of head mounting holes are made in a frame installed along a conveyance plane of the paper leaves for mounting the plurality of characteristic quantity detecting heads on the frame in a state where the plurality of characteristic quantity detecting heads face the conveyance plane, and each of the characteristic quantity detecting heads is detachably fitted only in the head mounting hole, of the plurality of head mounting holes, corresponding to a position at which a characteristic quantity remarkably develops.

At this time, it is also appropriate that a dummy head is detachably fitted in the head mounting hole, of the plurality of head mounting holes, in which the characteristic quantity detecting head is not fitted, to close the head mounting hole in a state of facing the paper leaves conveyance plane, that a back-up characteristic quantity detecting head to be used at the time of the occurrence of a trouble of the characteristic quantity detecting head is detachably fitted in some of the plurality of head mounting holes, and that each of the characteristic quantity detecting heads is a magnetic head made to detect, as the characteristic quantity information, a quantity of magnetism contained in a printed image on the paper leaves.

The above-described paper-leaves discriminating apparatus and sensor mounting construction in the same apparatus according to this invention allow the characteristic quantity detecting heads to be detachably fitted in the plurality of head mounting holes made in the frame, and enables the characteristic quantity detecting head to be fitted in only the head mounting hole corresponding to a position at which the characteristic quantity of the paper leaves remarkably develops, thereby easily coping with a change of the way and accomplishing the characteristic quantity detection at a point conforming to the way. Accordingly, it is possible to not only sharply simplify the check database and the check processing circuit to contribute to the reduction in the cost of the apparatus, but also considerably shorten the discrimination processing time.

In this case, when a dummy head is fitted in the head mounting hole where no characteristic quantity detecting head exists, the head mounting hole is closed to prevent the occurrence of jam of paper leaves. For instance, in the case that a pressing member is placed to press paper leaves against the characteristic quantity detecting head, if the head mounting hole is in the open condition, there is a possibility that the paper leaves pressed by the pressing member interfere with the head mounting hole. On the other hand, the presence of the dummy head closing the head mounting hole as mentioned above eliminates the interference of the paper leaves with the head mounting hole, so that it is possible to make a discrimination while certainly preventing the occurrence of the jam of the paper leaves.

Furthermore, a back-up characteristic quantity detecting head is fitted in the head mounting hole so that the discrimination is made on the basis of the characteristic quantity information from the back-up characteristic quantity detecting head at the time that the characteristic quantity detecting head develops trouble. Thus, even if a trouble of the characteristic quantity detecting head occurs, the paper-leaves discrimination processing can continuously take place without stopping the apparatus, which sharply improves the availability factor of the paper-leaves discriminating apparatus.

Still further, when a magnetic head is used as the characteristic quantity detecting head, the magnetic intensity of an printed image on the paper leaves is detectable as the characteristic quantity information on the paper leaves. Particularly, the magnetic head(s) is taken at a position(s) where the characteristic quantity of the paper leaves remarkably develops, that is, at a place(s) where a high magnetic intensity occurs, and the output of the magnetic head is sufficiently high, and therefore, even an economical magnetic head can surely detect the magnetic intensity forming the characteristic quantity information needed for the discrimination, thus realizing a further reduction of cost of the apparatus.

DESCRIPTION OF THE PREFERRED EMBODIMENTS

An embodiment of the present invention will be described hereinbelow with reference to the drawings. Likewise, a description of this invention will be given as a paper-leaves discriminating apparatus is an apparatus for discriminating between the truth and falsehood of paper money, that is, a paper money discriminating machine.

Figure 4:
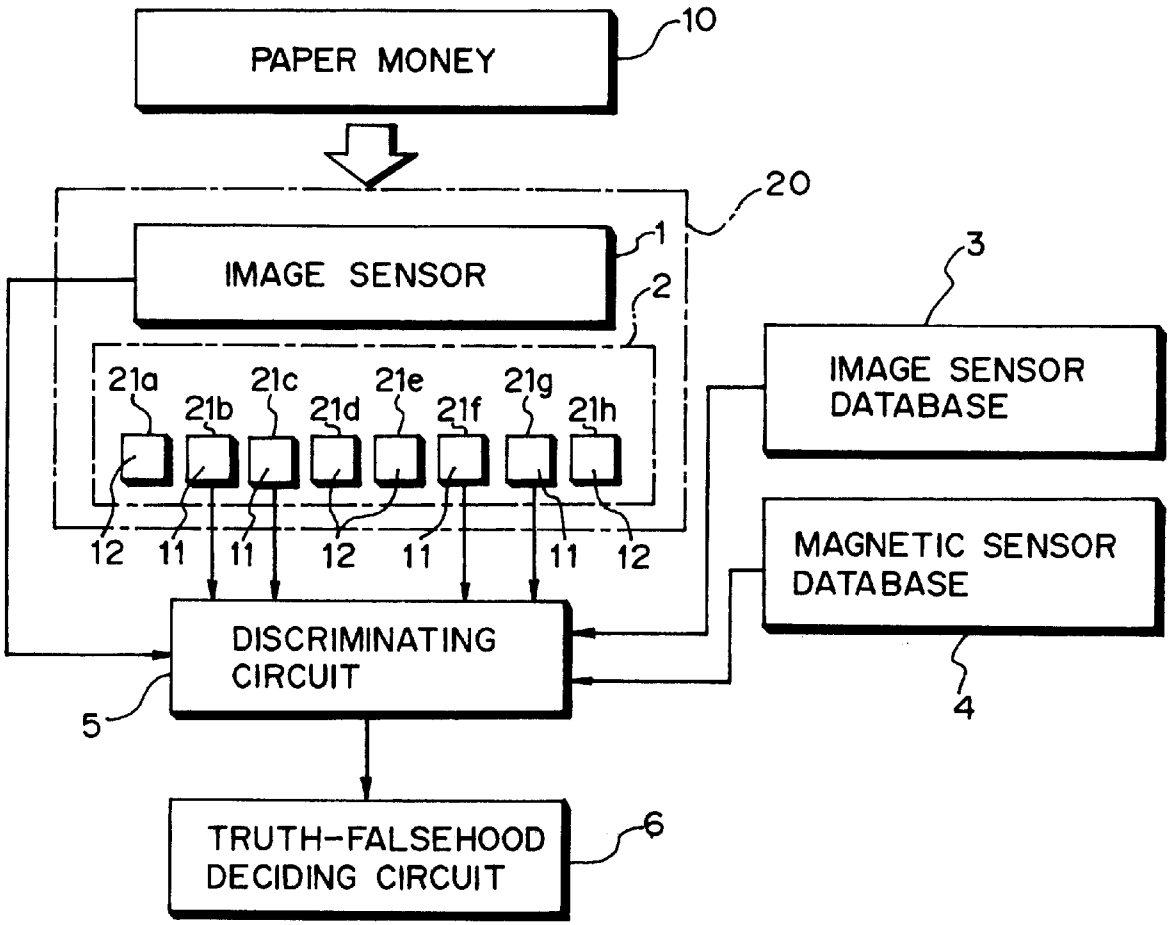
FIG. 4 is a block diagram showing a construction of the paper-leaves discriminating apparatus (paper money discriminating machine) according to this embodiment.

First of all, referring to FIG. 4, a description will be taken hereinbelow of a construction of a paper money discriminating machine. FIG. 4 is a block diagram showing this construction, and as shown in FIG. 4, the paper money discriminating machine according to this embodiment is made up of an image sensor 1, a magnetic sensor 2, an image sensor database 3, a magnetic sensor database 4, a discriminating circuit 5 and a truth-falsehood deciding circuit 6.

The image sensor 1 is for reading out a printed image on paper money as characteristic quantity information needed for discrimination, while the magnetic sensor 2 is for detecting a quantity of magnetism contained in ink producing the printed image on the paper money 10 as characteristic quantity information required for the discrimination.

In this embodiment, the magnetic sensor 2 is composed of a plurality of (in this embodiment, 4) magnetic heads (characteristic quantity detecting heads) 11 each for detecting a quantity of magnetism in the paper money 10 as characteristic quantity information. A detailed construction of this magnetic sensor 2 (a mounting construction for the magnetic heads 11) will be described herein later with reference to FIGS. 1 to 3C.

The image sensor database (check database) 3 is made to previously store printed image information on normal paper money, while the magnetic sensor database (check database) 4 is made to store magnetic intensity information on the normal paper money at a location (which will be described herein later) of each of the magnetic heads 11. For instance, the magnetic intensity information can be an allowable magnetic intensity range prescribed with the maximum allowable magnetic intensity and the allowable minimum magnetic intensity, or can also be a variation (or a variation state pattern) between the maximum magnetic intensity and the minimum magnetic intensity at a position of detection by each of the magnetic heads 11 in the transverse direction (conveying direction) of paper money. Incidentally, each of the locations of the magnetic heads 11 is a position at which the characteristic quantity of the normal paper money noticeably develops, that is, a place where a high magnetic intensity occurs, as described herein later with reference to FIGS. 5A and 5B.

Furthermore, the discriminating circuit (deciding circuit) 5 checks the printed image on the paper money 10 read through the image sensor 1 with the printed image information on the normal paper money stored in the image sensor database 3, and further, checks the magnetic intensity detected by each of the magnetic heads 11 constituting the magnetic sensor 2 with the magnetic intensity information at the corresponding position of the normal paper money stored in the magnetic sensor database 4, thus accomplishing the discrimination of the paper money 10.

The truth-falsehood deciding circuit 6 finally makes a decision on the truth or falsehood of the paper money 10 on the basis of the discrimination result (information about the check result) by the discriminating circuit 5.

Figure 1:
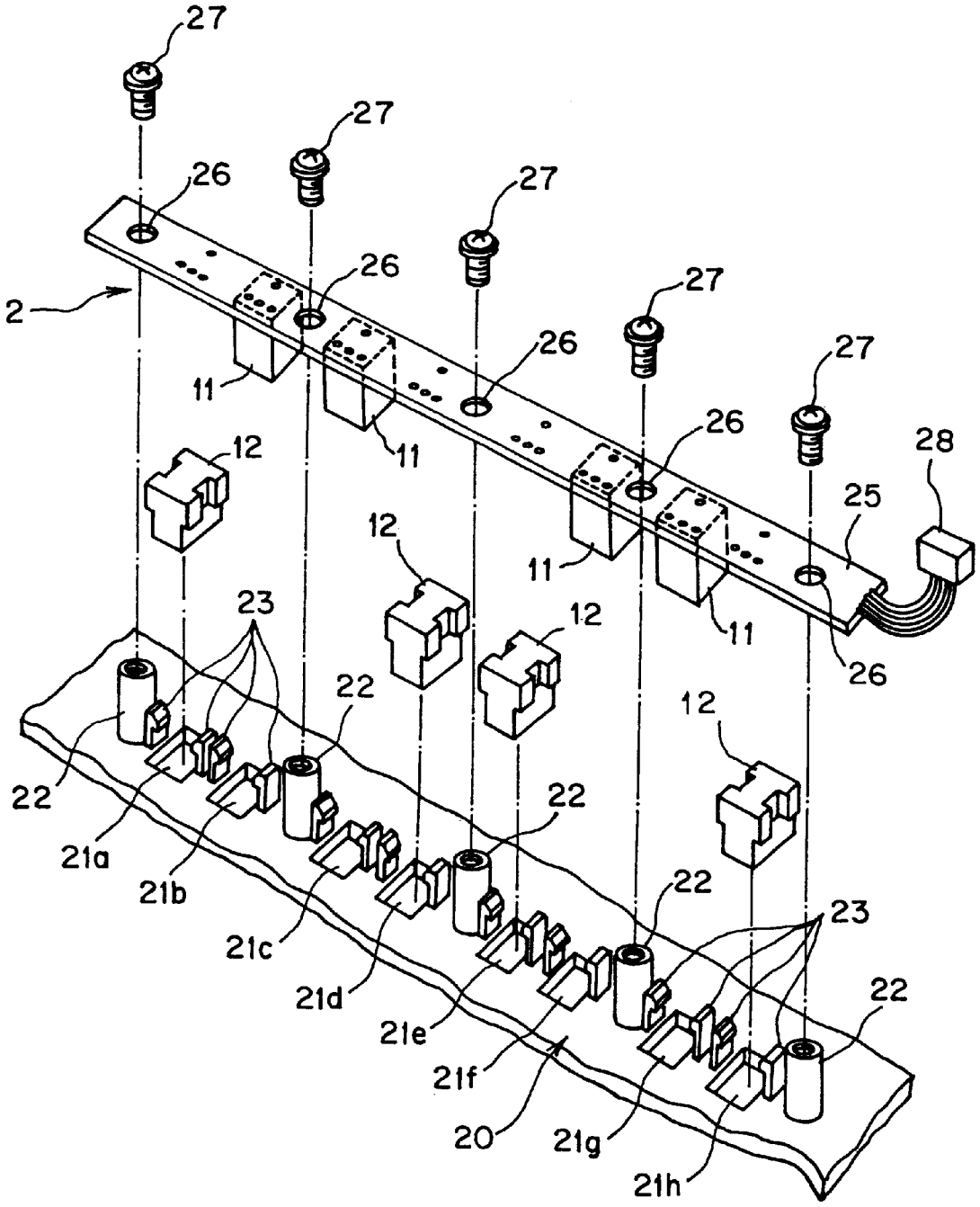
FIG. 1 is an exploded perspective view showing a sensor mounting construction in a paper-leaves discriminating apparatus (paper money discriminating machine) according to an embodiment of the present invention.
Figure 2:
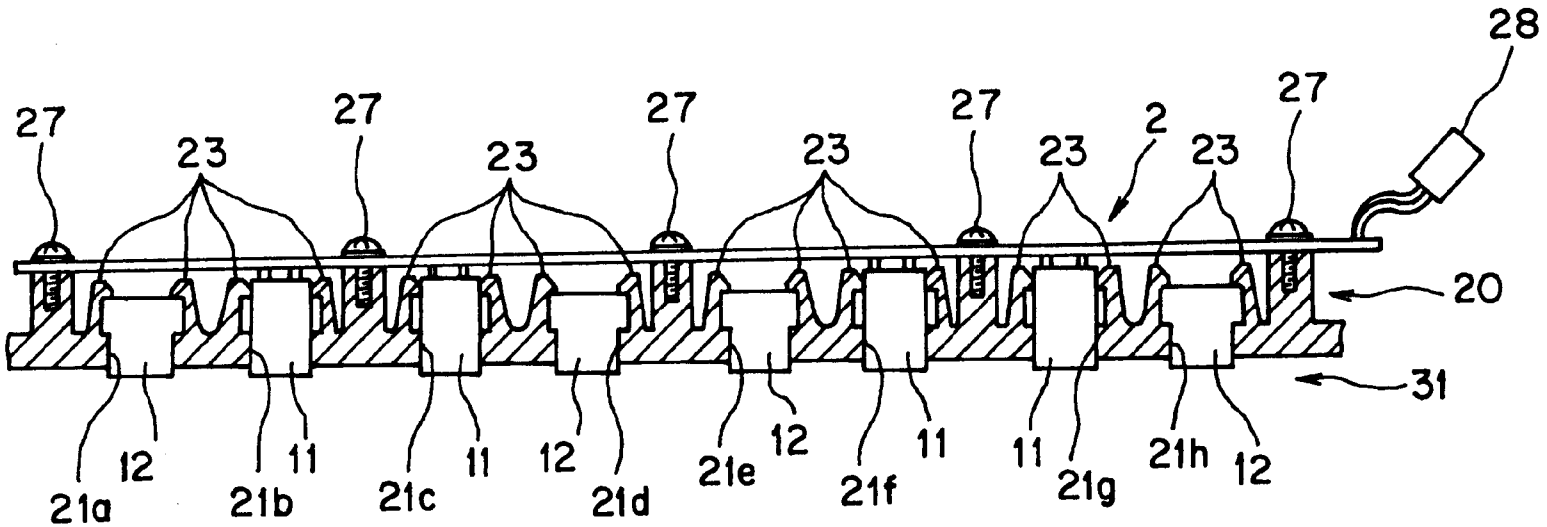
FIG. 2 is a cross-sectional view showing the sensor mounting construction according to this embodiment.
Figure 3A:
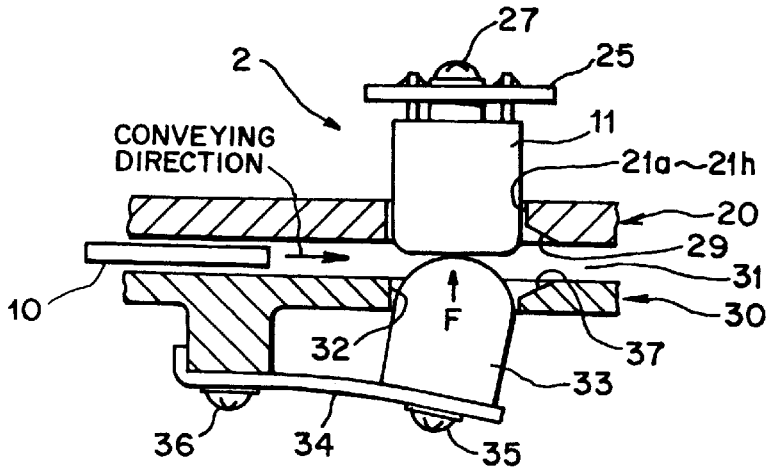
FIGS. 3A to 3C are cross-sectional views showing a principal portion for describing a structure in the vicinity of a magnetic head and a function (operation) of a dummy head in this embodiment.
Figure 3B:
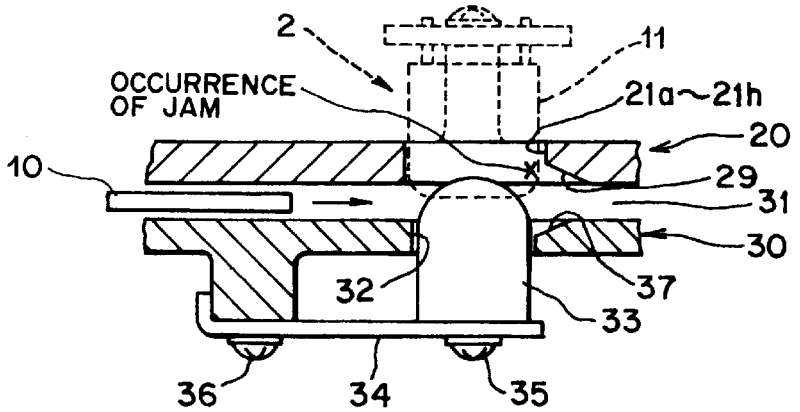
Figure 3C:
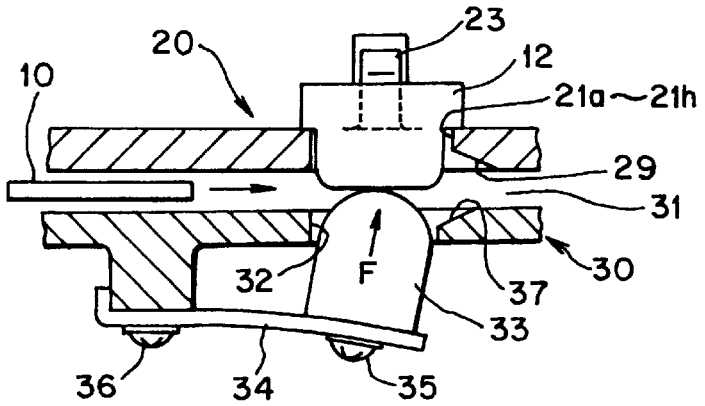

Secondly, referring to FIGS. 1 to 3C, a description will be made hereinbelow of a sensor mounting construction (magnetic head 11 mounting construction) in the above-described paper money discriminating machine according to this embodiment. FIGS. 1 and 2 are an exploded perspective view and a cross-sectional view respectively showing a sensor mounting construction in the paper money discriminating machine according to this embodiment, and FIGS. 3A to 3C are cross-sectional views showing a principal portion for describing a structure in the vicinity of the magnetic head and a function (operation) of a dummy head in this embodiment.

In the sensor mounting construction according to this embodiment, a frame 20 to which the image sensor 1 and the magnetic sensor 2 (magnetic heads 11) are attached is placed along a conveyance passage (conveyance plane) 31. The conveyance passage 31 for the paper money 10 is defined between the frame 20 and a frame 30 disposed in an opposed relation to the frame 20, and the paper money 10 is conveyed along the conveyance passage 31 by a non-shown conveyance drive system.

Figure 8:
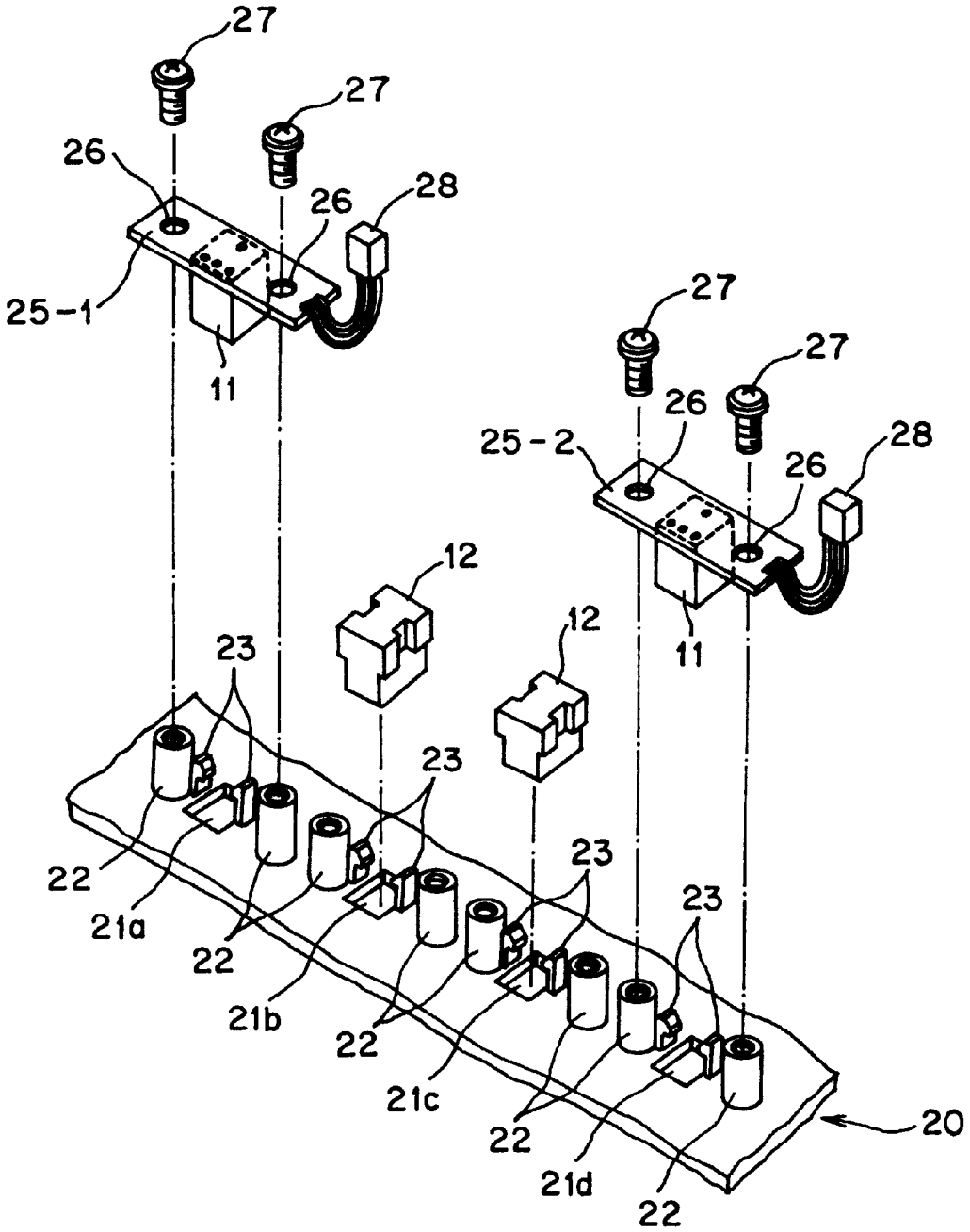
FIG. 8 is an exploded perspective view showing a modification of the sensor mounting construction according to this embodiment.

As shown in FIGS. 1 and 2, 8 head mounting holes 21*a* to 21*h* are made in the frame 20 so that a maximum of 8 magnetic heads 11 are mountable on the frame 20. These head mounting holes 21*a* to 21*h* are disposed along the longitudinal direction of the paper money 10 passing through the conveyance passage 31 (a direction perpendicular to the conveying direction of the paper money 10). The magnetic heads 11 are fitted in the corresponding head mounting holes 21*a* to 21*h*, respectively, so that the detecting surfaces of the magnetic heads 11 face the conveyance passage (conveyance plane) 31, and in this state, the magnetic heads 11 are fixedly but detachably mounted on the frame 20.

Figure 5A:
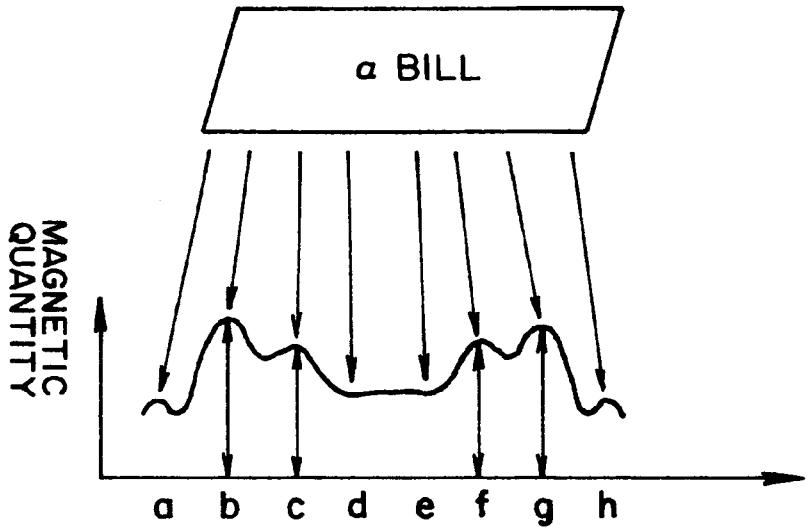
FIGS. 5A and 5B are illustrations useful for explaining the positions at which a characteristic quantity remarkably appears in paper leaves (paper money)

Meanwhile, in the discrimination way according to this embodiment, if being normal, the discrimination is made with respect to paper money (α bill) having a magnetic characteristic as shown in FIG. 5A. That is, the paper money (α bill) being discriminated has a magnetic distribution in its longitudinal direction as shown in FIG. 5A, and its characteristic quantity noticeably develops at the positions b, c, f and g, in other words, the magnetic intensity increases thereat. Besides, the positions (the positions in the longitudinal direction of the paper money 10) a to h correspond to the positions of the head mounting holes 21*a* to 21*h* made in the frame 20, respectively.

Accordingly, in the case of discriminating paper money having a magnetic characteristic shown in FIG. 5A, in the sensor mounting construction according to this embodiment, as shown in FIGS. 1 and 2, the magnetic heads 11 are detachably fitted in the head mounting holes 21*b*, 21*c*, 21*f* and 21*g* corresponding to the positions b, c, f and g at which the characteristic quantity remarkably develops. Incidentally, for the detection of the magnetic intensity irrespective of the inserting direction (the front, rear, surface or back side direction), the magnetic heads 11 are symmetrically mounted and disposed on the right and left sides.

Furthermore, dummy heads 12 are detachably fitted in the head mounting holes 21*a*, 21*d*, 21*e* and 21*h* not accommodating the magnetic heads 11 in the opposed relation to the conveyance passage (conveyance plane) 31 for the paper money 10 to close the head mounting holes 21*a*, 21*d*, 21*e* and 21*h*.

On both the sides of each of the mounting holes 21*a* to 21*h*, formed are dummy head locking hooks 23, 23 for fixing the dummy heads 12. Each of the dummy heads 12 is formed to have a slightly larger width than that of the magnetic heads 11, and the interval between the dummy head locking hooks 23, 23 is made to be slightly larger than the width of the magnetic heads 11 and to be slightly smaller than the width of an upper portion of the dummy head 12.

Accordingly, as shown in FIG. 2, the dummy head locking hooks 23, 23 do not interfere with each of the magnetic heads 11 when the magnetic head 11 is inserted into the corresponding one of the head mounting holes 21*a* to 21*h*, but interfering with each of the dummy heads 12 when the dummy head 12 is inserted into the corresponding one of the head mounting holes 21*a* to 21*h*. Further, when the dummy head 12 is pushed into the corresponding one of the head mounting holes 21*a* to 21*h*, the interval between the dummy head locking hooks 23, 23 is broadened by the pushing, and then, as shown in FIGS. 2 and 3C, the top surface of the dummy head 12 is engaged by the dummy head locking hooks 23, 23 from both the sides.

Whereupon, the dummy head 12 is fixed to the frame 20 (in each of the head mounting holes 21*a* to 21*h*). Besides, by broadening the interval between the dummy head locking hooks 23, 23 to release the dummy head 12 from the engaging condition with the dummy head locking hooks 23, 23, the dummy head 12 is readily removable from the corresponding one of the head mounting holes 21*a* to 21*h*.

In this embodiment, the four magnetic heads 11 to be mounted on the frame 20 are placed at appropriate positions on a printed board 25 in advance, and after the installation of the dummy heads 12, are mounted on the frame 20 together with the printed board 25. In the printed board 25, screw penetrating holes 26 are made at the positions corresponding to a plurality of (in this embodiment, 5) screw engaging holes 22 bored in the frame 20.

Moreover, printed board fixing screws 27, after penetrating the screw penetrating holes 26, are tightened up with respect to the screw engaging holes 22, so that the magnetic heads 11, together with the printed board 25, are fixedly secured to the frame 20. Besides, a detection signal from each of the magnetic heads 11 attached to the printed board 25 runs through a connector 28 to the discriminating circuit 5.

Furthermore, in general, in the case that the magnetic intensity is detected by the magnetic head 11, if the object (paper money 10) to be detected is not pressed against the magnetic head 11 by a pressing force of approximately several tens grams, the reading of the magnetic intensity becomes unstable.

Thus, as shown in FIGS. 3A to 3C, pressing members 33 are attached to the frame 30 placed to face the frame 20. Each of the pressing members 33 is made to penetrate a pressing member protrusion hole 32 from the lower surface side of the frame 30 to protrude from the upper surface side of the frame 30, thereby pressing the paper money 10 traveling within the conveyance passage 31 against the corresponding magnetic head 11 (or dummy head 12) by an appropriate pressing force F (for example, 50 g). The pressing member 33 is fitted through a fitting screw 35 to a tip side of a plate spring 34, while the proximal portion of the plate spring 34 is fitted through a fitting screw 36 to the lower surface of the frame 30. The pressing force F by the pressing member 33 is adjustable by the plate spring 34.

Furthermore, as shown in FIGS. 3A to 3C, a tapered surface 29 is formed on the conveyance passage 31 side of the paper money 10 and on the downstream side in the conveyance of the paper money 10 in each of the head mounting holes 21*a* to 21*h* to smoothly accomplish the conveyance of the paper money 10. Likewise, in each of the pressing member protrusion holes 32 of the frame 30, a tapered surface 37 is formed on the conveyance passage 31 side of the paper money 10 and on the downstream side in the conveyance of the paper money 10 in each of the head mounting holes 21*a* to 21*h* to smoothly accomplish the conveyance of the paper money 10.

In the paper money discriminating machine thus constructed according to this embodiment, the paper money 10 inserted from the external is conveyed along the conveyance passage 31 and, in the meantime, the printed image on the paper money 10 is read by the image sensor 1, and further, the magnetic quantities are detected by the magnetic sensor 2 at proper positions of the paper money 10 in its longitudinal direction. Concretely, in this embodiment, the magnetic quantities of the paper money 10 are detected by the magnetic head 11 at four places where the characteristic quantity remarkably appears (the positions b, c, f and g each developing a high magnetic intensity).

The information obtained from these sensors 1 and 2 are inputted to the discriminating circuit 5 which in turn, checks the printed image on the paper money 10 from the image sensor 1 with the printed image information on the normal paper money in the image sensor database 3, and further, checks each of the magnetic quantities from the four magnetic heads 11 of the magnetic sensor 2 with each of the magnetic intensity information [the allowable magnetic intensity range (allowable maximum magnetic intensity/allowable minimum magnetic intensity) prescribed by each of the positions b, c, f and g] on the normal paper money in the magnetic sensor database 4, thereby accomplishing the discrimination of the paper money 10. Further, the truth-falsehood deciding circuit 6 finally makes a decision on the truth or falsehood of the paper money 10 on the basis of the discrimination result (information about the check result) by the discriminating circuit 5.

Moreover, in this embodiment, the magnetic heads 11 can detachably be fitted in the plurality of head mounting holes 21*a* to 21*h* made in the frame 20, and because the magnetic heads 11 are fitted in the head mounting holes 21*b*, 21*c*, 21*f* and 21*g* corresponding to the positions at which the characteristic quantity of the paper money 10 remarkably appears, it is possible to easily cope with the change of the discriminating way, and further, to perform the magnetic intensity detection at a point confirming to the discriminating way.

Figure 5B:
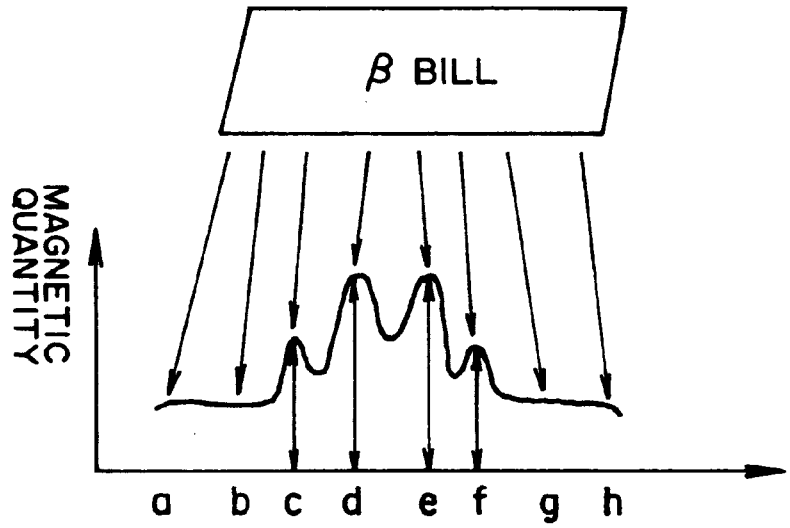

For instance, when the discrimination way(the issuing nation or the sorts of paper money) changes, if being normal, the discrimination is made with respect to paper money (β bill) having a magnetic characteristic as shown in FIG. 5B. That is, in the case that the magnetic intensity of the paper money (β bill) being now discriminated increases at the positions c, d, e and f in its longitudinal direction, the magnetic heads 11 are detachably fitted in the head mounting holes 21*c*, 21*d*, 21*e* and 21*f* corresponding to the positions c, d, e and f at which the magnetic intensity remarkably appears, while the dummy heads 12 are detachably fitted in the head mounting holes 21*a*, 21*b*, 21*g* and 21*h*, in which the magnetic heads 11 do not exist, in the opposed relation to the conveyance passage (conveyance plane) 31 for the paper money 10 to close the head mounting holes 21*a*, 21*b*, 21*g* and 21*h*. At this time, naturally, the magnetic intensity information on the normal paper money stored in the magnetic sensor database 4 is modified to conform to the paper money (β bill) to be newly discriminated.

At this time, since the dummy heads 12 are fitted in the head mounting holes (in the case of the α bill, the head mounting holes 21*a*, 21*d*, 21*e* and 21*h*, and in the case of the β bill, the head mounting holes 21*a*, 21*b*, 21*g* and 21*h*), in which the magnetic heads 11 are not fitted, to close these head mounting holes, the occurrence of jam of the paper money 10 is preventable.

Concretely, in the case that the pressing member 33 is provided to press the paper money 10 against the magnetic head 11, as shown in FIG. 3B, if any one of the head mounting holes 21*a* to 21*h* is in the open condition, the pressing member 33 protrudes to come in the one of the head mounting holes 21*a* to 21*h* so that the paper money 10 pressed by the pressing member 33 interferes with the one of the head mounting holes 21*a* to 21*h*, which can cause the jam of the paper money 10.

However, even if the pressing member 33 does not exist, when any one of the head mounting holes 21*a* to 21*h* is in the open condition, a burr or the like of the paper money 10 can be caught by the one of the head mounting holes 21*a* to 21*h*, thereby bringing about the jam of the paper money 10.

On the other hand, in this embodiment, as shown in FIG. 3C, the one of the head mounting holes 21*a* to 21*h* in which the magnetic head 11 is not fitted is closed with the dummy head 12, and therefore, the interference of the paper money 10 with the one of the head mounting holes 21*a* to 21*h* does not occur, so that the occurrence of the jam of the paper money 10 is certainly preventable.

Thus, in the paper money discriminating machine according to the embodiment of this invention, the magnetic heads 11 are placed at the places where the characteristic most displays at every nation or money sort, and therefore, it is possible to easily deal with the change of the discriminating way, and further, to perform the magnetic intensity detection at the point conforming to the discriminating way.

Accordingly, the magnetic sensor database 4 is not required to store an extremely large volume of data such as magnetic distributions, but simply stores the magnetic intensity information (allowable magnetic intensity range) for, for example, four places, which can considerably simplify the magnetic sensor database 4 and the discriminating circuit (check processing circuit) 5, thus not only reducing the apparatus cost but also considerably shortening the decision processing time.

In addition, since some of the head mounting holes 21*a* to 21*h*, not carrying the magnetic heads 11, are closed by the dummy heads 12, the paper money 10 can be conveyed without interfering with the head mounting holes 21*a* to 21*h*, so that the decision is feasible while the occurrence of the jam is surely preventable.

Moreover, since the magnetic heads 11 are used at the positions where the characteristic quantity of the paper money 10 remarkably develops, that is, at the places providing a high magnetic intensity, the output of each of the magnetic heads 11 becomes sufficiently high, and the magnetic intensity forming the characteristic quantity information needed for the decision is surely detectable through the use of an economical magnetic head 11, which can realize further reduction of the apparatus cost.

Figure 6:
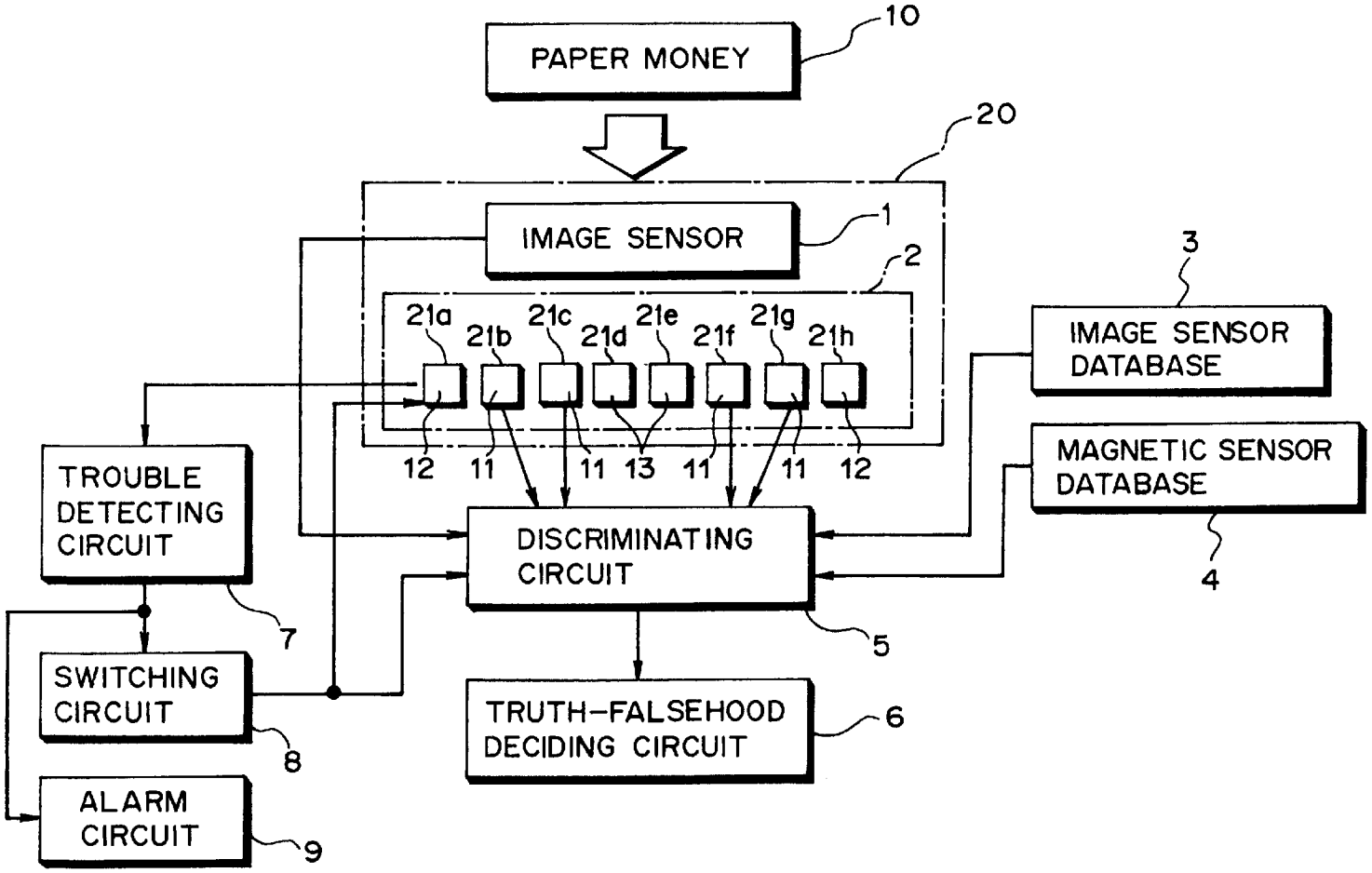
FIG. 6 is a block diagram showing a construction of a modification of the paper-leaves discriminating apparatus (paper money discriminating machine) according to this embodiment.

Meanwhile, it is also appropriate that the above-described paper money discriminating machine according to this embodiment is additionally equipped with a trouble detecting circuit 7, a switching circuit 8, an alarm circuit 9 and back-up magnetic heads (back-up characteristic quantity detecting heads) 13 as shown in FIG. 6. FIG. 6 is a block diagram showing a construction of a modification of the paper money discriminating machine according to this embodiment. In FIG. 6, the same numerals as those used above signify the same or substantially same sections, and the description thereof will be omitted for brevity.

In the modification shown in FIG. 6, the back-up magnetic heads (back-up characteristic quantity detecting heads) 13 to be used at the occurrence of trouble of the magnetic heads 11 are detachably fitted in the head mounting holes 21*d*, 21*e* of the frame 20. Besides, as well as the above-described embodiment, the magnetic heads 11 to be normally used are detachably fitted in the head mounting holes 21*b*, 21*c*, 21*f* and 21*g* of the frame 20, while the dummy heads 12 are detachably fitted in the head mounting holes 21*a*, 21*h* of the frame 20.

Furthermore, the trouble detecting circuit 7 is for detecting, if any, a trouble or breakdown of any one of the four magnetic heads to be regularly used, while the switching circuit 8 is for, when the trouble detecting circuit 7 detects a trouble of the magnetic head 11, automatically switching it to the back-up magnetic head 13 so that the magnetic intensity is detected by the back-up magnetic head 13.

Figure 7:
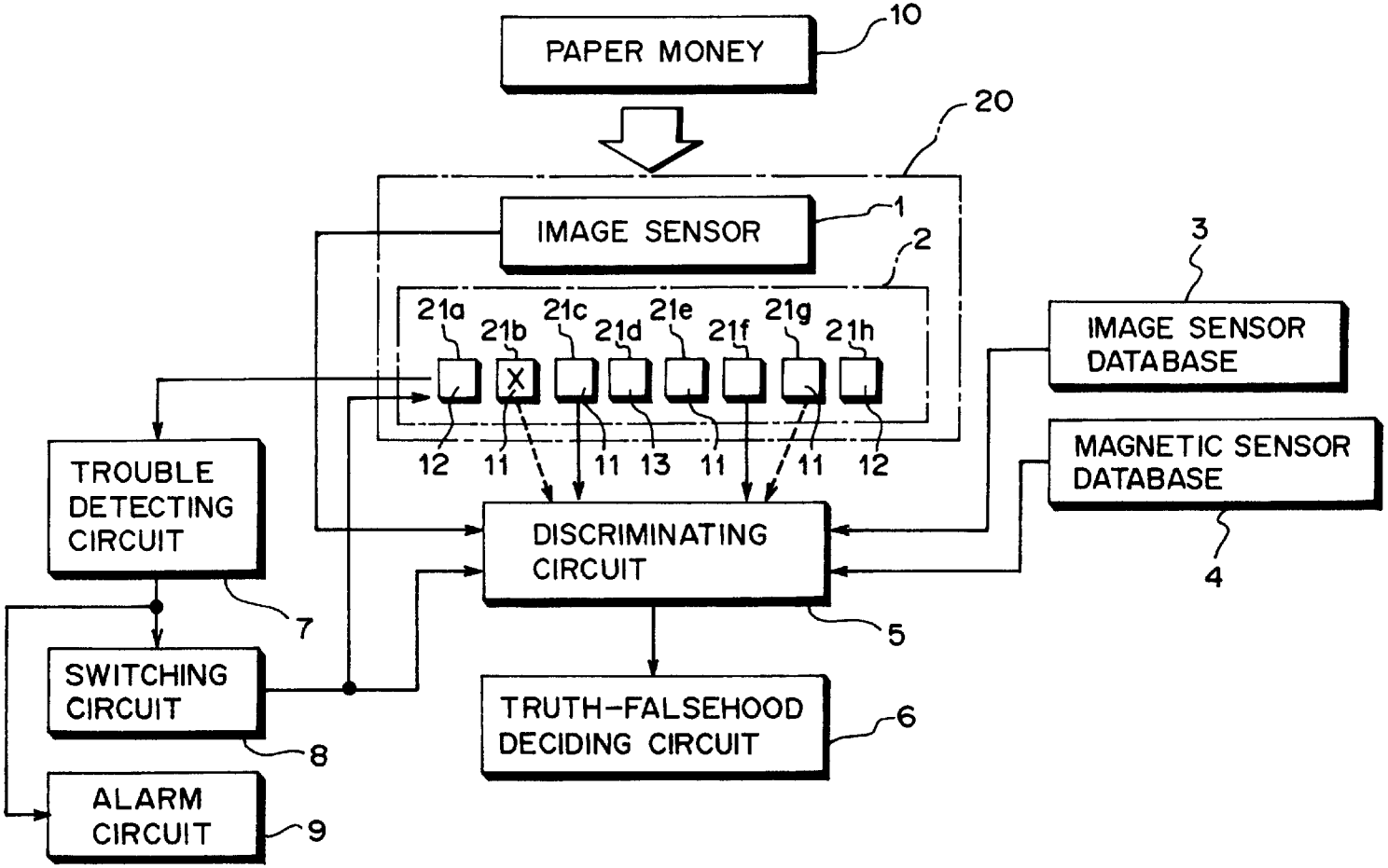
FIG. 7 is an illustration available for explaining an operation of the modification of the paper-leaves discriminating apparatus (paper money discriminating machine) according to this embodiment.

In this case, for detecting the magnetic intensity regardless of the inserting direction (the front or rear surface) of the paper money 10, the switching by the switching circuit 8 is done so that the magnetic heads 11, 13 to be used for the detection of the magnetic intensity are symmetrically disposed on the right and left sides. For instance, as shown in FIG. 7, if the magnetic head 11 fitted in the head mounting hole 21*b* gets out of order, the switching circuit 8 automatically conducts the switching operation so that the magnetic quantities of the paper money 10 detected by the magnetic heads 11 fitted in the head mounting holes 21*c*, 21*f* and the back-up magnetic heads 13 fitted in the head mounting holes 21*d*, 21*e* are inputted to the discriminating circuit 5.

The alarm circuit 9 is made to, when the trouble detecting circuit 7 detects a trouble of the magnetic head 11, raise a maintenance alarm (for example, a lamp goes on or off, or a buzzer vibrates) to inform the operator or the like of the trouble.

Furthermore, as in the case of the above-described embodiment, the magnetic intensity information at the positions b, c, f and g are stored in the magnetic database 4 in the modification shown in FIG. 6, and the magnetic intensity information on the normal paper money for the fitting positions d, e of the back-up magnetic heads 13 are previously stored therein as the back-up magnetic intensity information.

Still further, when one magnetic head 11 goes into a trouble, the discriminating circuit 5 makes a decision by checking the magnetic intensity information detected by the magnetic heads 11 and the back-up magnetic heads 13 with the magnetic intensity information and the back-up magnetic intensity information in the magnetic sensor database 4.

For instance, as shown in FIG. 7, when the magnetic head 11 fitted in the head mounting hole 21*b* gets out of order, the discriminating circuit 5 checks the magnetic intensity information from the magnetic heads 11 fitted in the head mounting holes 21*c*, 21*f* with the magnetic intensity information at the positions c, f in the magnetic sensor database 4, and further, checks the magnetic intensity information from the back-up magnetic heads 13 fitted in the head mounting holes 21*d*, 21*e* with the back-up magnetic intensity information at the positions c, f in the magnetic sensor database 4.

When receiving the maintenance alarm, showing the fact that the magnetic head 11 gets out of order, from the alarm circuit 9, the operator recognizes the occurrence of the trouble of the magnetic head 11 through that maintenance alarm, and repairs the magnetic head 11 existing in the head mounting hole 21*b* at the maintenance of the paper money discriminating machine, before resetting the paper money discriminating machine so that the magnetic heads 11 fitted in the head mounting holes 21*b*, 21*c*, 21*f* and 21*g*, originally taking charge of the detection, instead conducts the magnetic intensity detection.

Thus, according to the paper money discriminating machines described with reference to FIGS. 6 and 7, even though a trouble of the magnetic head(s) 11 occurs, it is possible to continuously perform the discrimination processing for the paper money 10 without stopping the apparatus, and hence, to sharply enhance the availability factor of the paper money discriminating machine.

Figure 10:
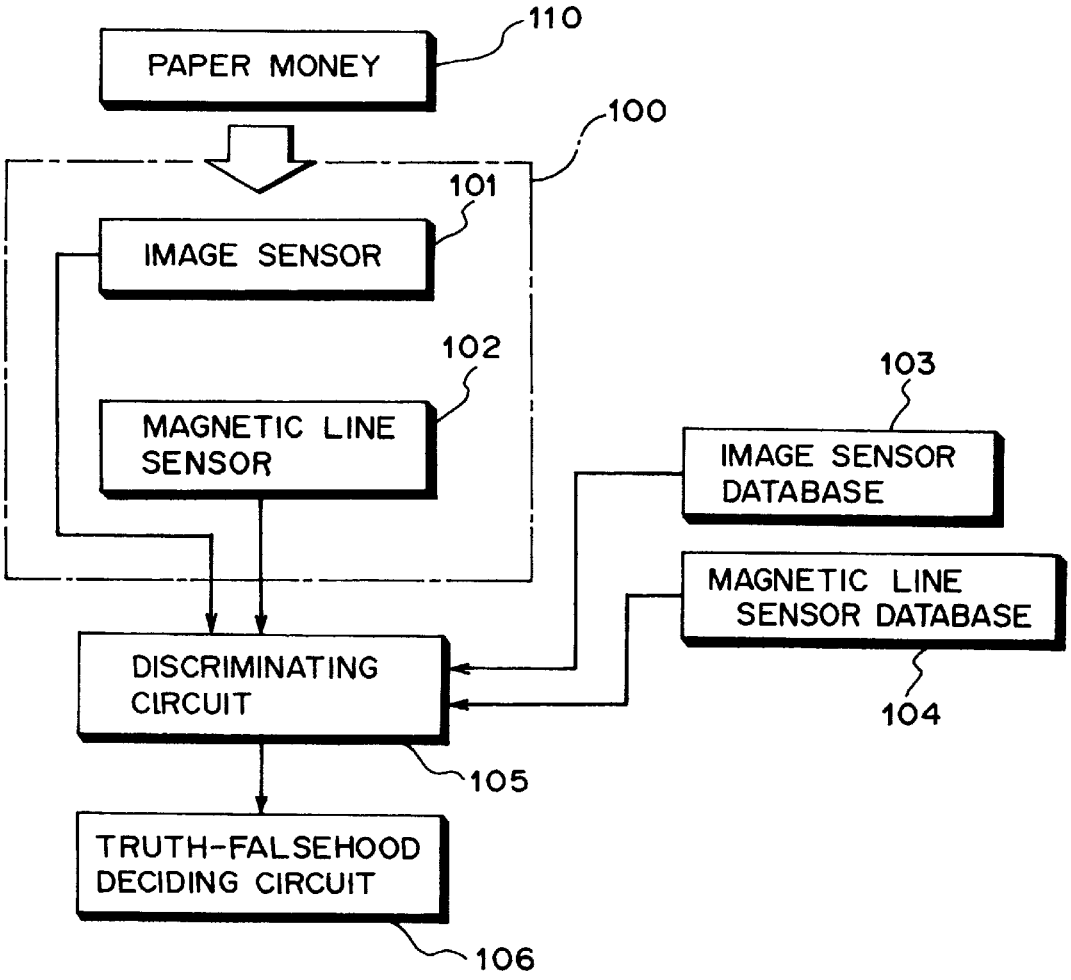
FIG. 10 RELATED ART
FIG. 10 is a block diagram showing a construction of a common paper-leaves discriminating apparatus (paper money discriminating machine).

Moreover, in the case of employing the magnetic line sensor 102 shown in FIG. 10, if only one of a large number of magnetic detecting elements constituting the magnetic line sensor 102 gets out of order, there is a need to immediately stop the operation of the paper money discriminating machine to replace the entire magnetic line sensor 102. On the other hand, in the case of the paper money discriminating machines shown in FIGS. 6 and 7, even if the magnetic head(s) 11 goes into trouble or breakdown, there is no need to immediately stop the operation of the paper money discriminating machine, and the replacement/repair of only the broken magnetic head 11 is possible, thus cutting down the cost associated with the maintenance of the paper money discriminating machine.

Incidentally, it should be understood that the present invention is not limited to the above-described embodiments, and that it is intended to cover all changes and modifications of the embodiments of the invention herein which do not constitute departures from the spirit and scope of the invention.

Although, in the description of the embodiment, 8 head mounting holes 21*a* to 21*h* are made in the frame 20 and four magnetic heads 11 are fitted therein, this invention is not limited to these numbers. Further, although, in the above-described embodiment, the four magnetic heads 11 are attached onto one printed board 25, this invention is not limited to this structure, but each of the magnetic heads 11 can also be attached to each of printed boards obtained by dividing the printed board.

Figure 9:
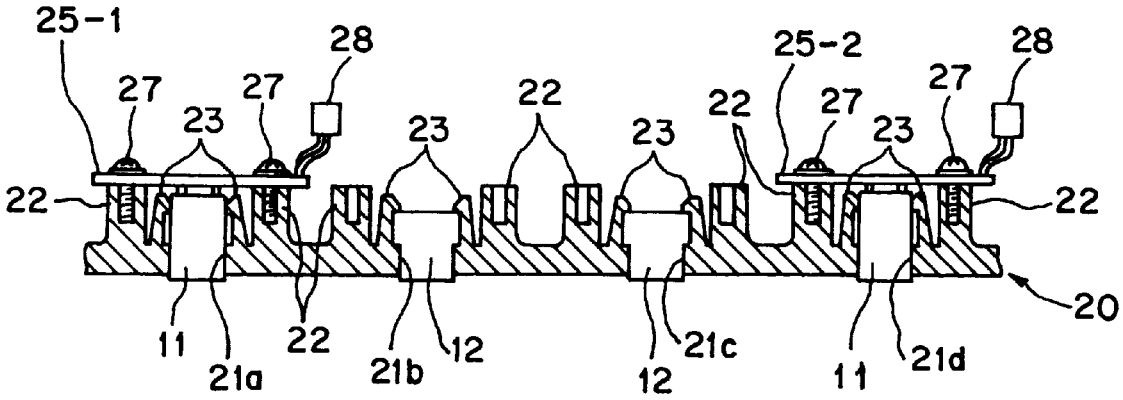
FIG. 9 is a cross-sectional view showing the modification of the sensor mounting construction according to this embodiment.

For instance, FIGS. 8 and 9 are an exploded perspective view and a cross-sectional view showing a modification of the sensor mounting construction according to this embodiment, and in the modification shown in FIGS. 8 and 9, four head mounting holes 21*a* to 21*d* are made in the frame 20 and two magnetic heads 11 are fitted therein. The two magnetic heads 11, 11 are inserted into the head mounting holes 21*a*, 21*d* in a state of being attached onto printed boards 25-1, 25-2. In addition, as in the case of the printed board 25 in the above-described embodiment, in a manner that printed board fixing screws 27, penetrating screw penetrating holes 26, are tightened up against screw engaging holes 22 of the frame 20, the two magnetic heads 11, 11, together with the printed boards 25-1, 25-2, are fixed to the frame 20. Further, as well as the above-described embodiment, dummy heads 12 are fitted in the head mounting holes 21*b*, 21*c*. Incidentally, in FIGS. 8 and 9, the same numerals as those used above signify the same or substantially same sections, and the description thereof will be omitted for simplicity.

Even the sensor mounting construction shown in FIGS. 8 and 9 can provide the same effects as those of the above-described embodiment, and since one magnetic head 11 is installed on one printed board, if the magnetic head 11 gets out of order, the repair/replacement is possible by removing only the broken magnetic head 11 without removing all the magnetic heads 11.

Furthermore, although, in the description, the embodiment is applied to a paper money discriminating machine which makes a discrimination (makes a decision on the truth or falsehood) on paper money being paper leaves, this invention is not limited to this, but is similarly applicable to the case of discriminating the sorts of paper leaves (kinds of bills).

Still further, although, in the description of the embodiment, the paper leaves are paper money, this invention is not limited to this, but is likewise applicable to paper leaves other than paper money, for example, securities.

Moreover, although, in the description of the embodiment, the characteristic information is a magnetic intensity contained in a magnetic ink forming a printed image on paper money and this magnetic intensity is detected by the magnetic sensor 2 (magnetic heads 11), this invention is not limited to this, but is also applicable to the case that a sensor detects printed image information, optical information or the like as the characteristic quantity information, and even in this case, the same effects as those of the above-described embodiment are obtainable.

What is claimed is:

1. A paper-leaves discrimination apparatus comprising:

a sensor to detect characteristic quantity information in paper leaves needed to discriminate between the truth and falsehood or among the sorts of said paper leaves;

a check database to store characteristic quantity information on normal paper leaves; and a discriminating circuit to make said discrimination by checking said characteristic quantity information in said paper leaves detected by said sensor with said characteristic quantity information in said check database, wherein said sensor includes a plurality of characteristic quantity detecting heads each to detect said characteristic quantity information, and a frame on which said characteristic quantity detecting heads are mounted is provided along a conveyance plane of said paper leaves, and said frame has a plurality of head mounting holes to mount said plurality of characteristic quantity detecting heads on said frame in a state of said characteristic quantity detecting heads facing said conveyance plane, and each of said plurality of characteristic quantity detecting heads is detachably fitted only in said head mounting hole, of said plurality of head mounting holes, corresponding to a position at which a characteristic quantity remarkably develops, and a dummy head is detachably fitted in said head mounting hole, of said plurality of head mounting holes, in which said characteristic quantity detecting head is not fitted, to close said head mounting hole in a state of facing said paper leaves conveyance plane.

2. A paper-leaves discriminating apparatus as defined in claim 1, wherein a back-up characteristic quantity detecting head to be used at the time of the occurrence of a trouble of said characteristic quantity detecting head is detachably fitted in some of said plurality of head mounting holes, and a switching circuit is provided which, when said characteristic quantity detecting head gets into trouble, automatically conducts a switching operation so that said back-up characteristic quantity detecting head detects said characteristic quantity information, and further, characteristic quantity information on said normal paper leaves at the fitted position of said back-up characteristic quantity detecting head is previously stored as back-up characteristic quantity information in said check database so that said discriminating circuit makes said discrimination by checking said characteristic quantity information detected by said back-up characteristic quantity detecting head with said back-up characteristic quantity information in said check database at the trouble of said characteristic quantity detecting head.

3. A paper-leaves discriminating apparatus as defined in claim 1, wherein each of said characteristic quantity detecting heads is a magnetic head made to detect, as said characteristic quantity information, a quantity of magnetism contained in a printed image on said paper leaves.

4. A paper-leaves discriminating apparatus as defined in claim 2, wherein each of said characteristic quantity detecting heads is a magnetic head made to detect, as said characteristic quantity information, a quantity of magnetism contained in a printed image on said paper leaves.

5. A paper-leaves discrimination apparatus comprising:

a sensor to detect characteristic quantity information in paper leaves needed to discriminate between the truth and falsehood or among the sorts of said paper leaves;

a check database to store characteristic quantity information on normal paper leaves; and a discriminating circuit to make said discrimination by checking said characteristic quantity information in said paper leaves detected by said sensor with said characteristic quantity information in said check database, wherein said sensor includes a plurality of characteristic quantity detecting heads each to detect said characteristic quantity information, and a frame on which said characteristic quantity detecting heads are mounted is provided along a conveyance plane of said paper leaves, and said frame has a plurality of head mounting holes to mount said plurality of characteristic quantity detecting heads on said frame in a state of said characteristic quantity detecting heads facing said conveyance plane, and each of said plurality of characteristic quantity detecting heads is detachably fitted only in said head mounting hole, of said plurality of head mounting holes, corresponding to a position at which a characteristic quantity remarkably develops, and a back-up characteristic quantity detecting head to be used at the time of the occurrence of a trouble of said characteristic quantity detecting head is detachably fitted in some of said plurality of head mounting holes, and a switching circuit is provided which, when said characteristic quantity detecting head gets into trouble, automatically conducts a switching operation so that said back-up characteristic quantity detecting head detects said characteristic quantity information, and further, characteristic quantity information on said normal paper leaves at the fitted position of said back-up characteristic quantity detecting head is previously stored as back-up characteristic quantity information in said check database so that said discriminating circuit makes said discrimination by checking said characteristic quantity information detected by said back-up characteristic quantity detecting head with said back-up characteristic quantity information in said check database at the trouble of said characteristic quantity detecting head.

6. A paper-leaves discriminating apparatus as defined in claim 5, wherein each of said characteristic quantity detecting heads is a magnetic head made to detect, as said characteristic quantity information, a quantity of magnetism contained in a printed image on said paper leaves.

7. A sensor mounting construction in a paper-leaves discriminating apparatus which makes a discrimination between the truth and falsehood or among sorts of paper leaves, said sensor mounting construction to mount a sensor to detect characteristic quantity information in said paper leaves needed for said discrimination, wherein said sensor includes a plurality of characteristic quantity detecting heads each to detect said characteristic quantity information, and a plurality of head mounting holes are made in a frame installed along a conveyance plane of said paper leaves to mount said plurality of characteristic quantity detecting heads on said frame in a state where said plurality of characteristic quantity detecting heads face said conveyance plane, and each of said characteristic quantity detecting heads is detachably fitted only in said head mounting hole, of said plurality of head mounting holes, corresponding to a position at which a characteristic quantity remarkably develops, and a dummy head is detachably fitted in said head mounting hole, of said plurality of head mounting holes, in which said characteristic quantity detecting head is not fitted, to close said head mounting hole in a state of facing said paper leaves conveyance plane.

8. A sensor mounting construction in a paper-leaves discriminating apparatus as defined in claim 7, wherein a back-up characteristic quantity detecting head to be used at the time of the occurrence of a trouble of said characteristic quantity detecting head is detachably fitted in some of said plurality of head mounting holes.

9. A sensor mounting construction in a paper-leaves discriminating apparatus as defined in claim 7, wherein each of said characteristic quantity detecting heads is a magnetic head made to detect, as said characteristic quantity information, a quantity of magnetism contained in a printed image on said paper leaves.

10. A sensor mounting construction in a paper-leaves discriminating apparatus as defined in claim 8, wherein each of said characteristic quantity detecting heads is a magnetic head made to detect, as said characteristic quantity information, a quantity of magnetism contained in a printed image on said paper leaves.

11. A sensor mounting construction in a paper-leaves discriminating apparatus which makes a discrimination between the truth and falsehood or among sorts of paper leaves, said sensor mounting construction to mount a sensor to detect characteristic quantity information in said paper leaves needed for said discrimination, wherein said sensor includes a plurality of characteristic quantity detecting heads each to detect said characteristic quantity information, and a plurality of head mounting holes are made in a frame installed along a conveyance plane of said paper leaves to mount said plurality of characteristic quantity detecting heads on said frame in a state where said plurality of characteristic quantity detecting heads face said conveyance plane, and each of said characteristic quantity detecting heads is detachably fitted only in said head mounting hole, of said plurality of head mounting holes, corresponding to a position at which a characteristic quantity remarkably develops, and a back-up characteristic quantity detecting head to be used at the time of the occurrence of a trouble of said characteristic quantity detecting head is detachably fitted in some of said plurality of head mounting holes.

12. A sensor mounting construction in a paper-leaves discriminating apparatus as defined in claim 11, wherein each of said characteristic quantity detecting heads is a magnetic head made to detect, as said characteristic quantity information, a quantity of magnetism contained in a printed image on said paper leaves.

* * * * *